US007771138B2

(12) United States Patent
Musil

(10) Patent No.: US 7,771,138 B2
(45) Date of Patent: Aug. 10, 2010

(54) MULTI-STAGE MODULAR ROAD PAVING EQUIPMENT AND METHOD OF MANUFACTURE AND SALES

(75) Inventor: Joseph E Musil, Ely, IA (US)

(73) Assignee: Terex USA, LLC, Wilmington, DE (US)

( * ) Notice: Subject to any disclaimer, the term of this patent is extended or adjusted under 35 U.S.C. 154(b) by 561 days.

(21) Appl. No.: 11/689,027

(22) Filed: Mar. 21, 2007

(65) Prior Publication Data

US 2007/0237582 A1 Oct. 11, 2007

Related U.S. Application Data

(60) Provisional application No. 60/743,657, filed on Mar. 22, 2006.

(51) Int. Cl.
*E01C 19/00* (2006.01)

(52) U.S. Cl. ..... 404/86; 404/108

(58) Field of Classification Search ..... 404/86, 404/109, 108, 110
See application file for complete search history.

(56) References Cited

U.S. PATENT DOCUMENTS

| | | | | | |
|---|---|---|---|---|---|
| 2,067,236 | A | | 1/1937 | McKnight | |
| 2,258,205 | A | * | 10/1941 | Halvorson | 404/110 |
| 2,386,025 | A | * | 10/1945 | Wills | 404/86 |
| 2,585,117 | A | * | 2/1952 | Gurries | 404/86 |
| 2,762,276 | A | * | 9/1956 | Mauch | 404/110 |
| 3,034,410 | A | * | 5/1962 | Ross et al. | 404/108 |
| 3,213,769 | A | * | 10/1965 | Smith | 404/110 |
| 3,373,669 | A | * | 3/1968 | Schmitz | 404/110 |
| 3,456,566 | A | * | 7/1969 | Lazaro | 404/108 |
| 3,482,494 | A | * | 12/1969 | Jennings, Jr. | 404/110 |
| 3,729,824 | A | | 5/1973 | Baues et al. | |
| 3,884,395 | A | * | 5/1975 | Keenan | 222/608 |
| 3,909,146 | A | * | 9/1975 | Hoffman | 404/110 |
| 3,967,913 | A | * | 7/1976 | Gabriel, Jr. | 404/109 |
| 4,188,152 | A | * | 2/1980 | Kitt | 404/110 |
| 4,470,783 | A | | 9/1984 | Friebel et al. | |
| 4,507,012 | A | * | 3/1985 | Corcoran et al. | 404/72 |
| 4,655,635 | A | * | 4/1987 | Furukawa | 404/108 |
| 4,702,642 | A | | 10/1987 | Musil | |
| 4,865,487 | A | | 9/1989 | Lutz | |
| 4,871,025 | A | * | 10/1989 | Mayfield et al. | 172/4.5 |
| 4,895,476 | A | * | 1/1990 | Vangaever | 404/108 |
| 4,955,754 | A | | 9/1990 | Smith | |
| 5,009,546 | A | | 4/1991 | Domenighetti et al. | |
| 5,015,120 | A | | 5/1991 | Brock et al. | |
| 5,035,534 | A | | 7/1991 | Brock et al. | |
| 5,201,603 | A | | 4/1993 | Bassett et al. | |
| 5,201,604 | A | | 4/1993 | Ferguson et al. | |
| 5,203,642 | A | | 4/1993 | Heller et al. | |
| 5,220,965 | A | * | 6/1993 | Haug | 171/116 |

(Continued)

FOREIGN PATENT DOCUMENTS

DE 196 34 013 A1 2/1998

*Primary Examiner*—Gary S Hartmann
(74) *Attorney, Agent, or Firm*—Simmons Perrine Moyer Bergman PLC

(57) ABSTRACT

A multi-stage modular road building equipment system where a first stage base tractor is coupled to an intermediate stage, such as a spreading screw, and a third stage screed road paving tool attachment or other attachment such as a widener.

10 Claims, 1 Drawing Sheet

U.S. PATENT DOCUMENTS 5,269,626 A 12/1993 Soliman et al.
5,304,013 A * 4/1994 Parsons ..... 404/127
5,362,178 A * 11/1994 Schantz ..... 404/101
D362,449 S 9/1995 Swisher, Jr.
5,470,175 A * 11/1995 Jensen et al. ..... 404/72
5,522,670 A 6/1996 Gilmore et al.
5,529,434 A 6/1996 Swisher, Jr.
5,533,829 A 7/1996 Campbell
5,553,969 A 9/1996 Reed
6,007,272 A 12/1999 Macku
6,050,744 A * 4/2000 Binning ..... 404/108
6,056,474 A 5/2000 Nolan
6,071,040 A 6/2000 Macku et al.
6,074,129 A 6/2000 Nowak et al.
6,079,901 A 6/2000 Banks et al.
6,113,310 A * 9/2000 Hesse, Jr. ..... 404/108
6,203,243 B1 3/2001 Birtchet
6,203,244 B1 * 3/2001 Van Ornum ..... 404/110
6,227,620 B1 * 5/2001 Page ..... 299/39.4
6,308,785 B1 10/2001 Rhoden
6,422,785 B1 7/2002 Ruggles et al.
6,481,925 B1 11/2002 Olson
6,514,007 B2 2/2003 Richter
6,543,962 B2 4/2003 Wells
6,582,152 B2 6/2003 Leone et al.
6,595,719 B1 7/2003 Ohseki et al.
6,612,774 B1 9/2003 Dulin
6,708,777 B1 * 3/2004 Holmes ..... 172/684.5
6,712,549 B2 3/2004 Roth
6,860,676 B2 3/2005 Pont Feixes
7,104,724 B2 * 9/2006 Terry ..... 404/110
7,104,726 B2 * 9/2006 Wallace ..... 404/128
7,108,450 B2 * 9/2006 Grubba ..... 404/84.5
7,316,520 B2 * 1/2008 Grubba ..... 404/84.05
7,441,987 B1 * 10/2008 Sampey ..... 404/98
7,470,082 B2 * 12/2008 Lloyd ..... 404/85
2003/0113166 A1 6/2003 Heims
2003/0215288 A1 * 11/2003 Causie et al. ..... 404/104
2003/0219309 A1 11/2003 Moore
2005/0058507 A1 3/2005 Musil

* cited by examiner

MULTI-STAGE MODULAR ROAD PAVING EQUIPMENT AND METHOD OF MANUFACTURE AND SALES

CROSS-REFERENCE TO RELATED APPLICATIONS

This application claims the benefit of provisional application No. 60/743,657 filed on Mar. 22, 2006.

FIELD OF THE INVENTION

The present invention generally relates to road paving equipment.

BACKGROUND OF THE INVENTION

In the past, road paving equipment designers have endeavored to improve the functionality of road pavers. Often, each new model of road paving equipment is designed from the ground up. In other words, the entire structure is often optimized for the particular type and model of paving equipment. In other cases, it has been proposed to have a dual stage approach where a base tractor is used and an assortment of interchangeable tool attachments is offered.

While these approaches of engineering paving equipment for a variety of functions have been used in the past, they do have some drawbacks. First of all, the number of uniquely designed models of paving equipment that can be offered for sale and delivery within a reasonable time frame is limited by the cost of maintaining an inventory of the entire product line. Secondly, the number of available options in a dual stage system which uses interchangeable tool attachments is limited.

Consequently, there exists a need for improved methods and systems for manufacturing and selling a variety of models of road building equipment with differing functions.

SUMMARY OF THE INVENTION

It is an object of the present invention to provide a system and method for manufacturing and selling a variety of road building equipment in an efficient manner.

It is a feature of the present invention to utilize a multi-stage modular manufacturing system.

It is an advantage of the present invention to reduce the cost of manufacturing and selling a variety of paving tools in an efficient manner.

The present invention is an apparatus and method for manufacturing and selling a variety of paving equipment models having differing functionality, designed to satisfy the aforementioned needs, provide the previously stated objects, include the above-listed features, and achieve the already articulated advantages. The present invention is carried out in an "excess work-in-process inventory-less" manner in a sense that the need to build an entire unit of each model of road building equipment and keep them in stock in order to provide an ability to deliver any one model in a timely manner, has been eliminated.

Accordingly, the present invention is a system and method including a multi-stage modular manufacturing system.

BRIEF DESCRIPTION OF THE DRAWINGS

The invention may be more fully understood by reading the following description of the preferred embodiments of the invention, in conjunction with the appended drawings wherein.

DETAILED DESCRIPTION

Figure 1:
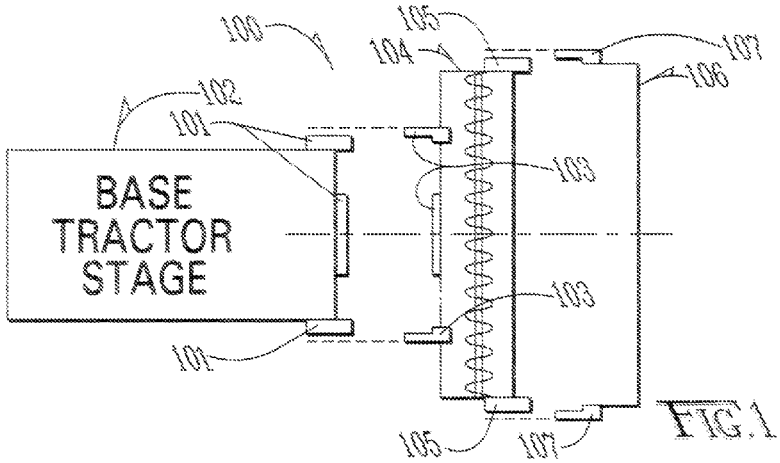
FIG. 1 is an exploded block diagram view of a multi-stage model of road paving equipment having a base stage, an intermediate stage, and a first tool stage, which is configured to mate with the intermediate stage.

Now referring to the drawings wherein like numerals refer to like matter throughout, and more specifically referring to FIG. 1, there is shown a multi-stage road paving equipment system, generally designated 100, including a base tractor stage 102, which can be any type of road paving equipment which provides controls and motive forces to other road building equipment; i.e., a tractor somewhat similar to the tractor shown in U.S. patent application Ser. No. 10/605,249 or other suitable substitutes. The base tractor stage 102 has a first stage-to-stage coupler 101 disposed thereon. This first stage-to-stage coupler 101 can take any form, such as welding, bolts, rivets, etc.; however, it specifically excludes any connector which is configured for rapidly attaching and detaching in the field.

The base tractor stage 102 is coupled via first stage-to-stage coupler 101 and first stage-to-stage coupler 103 to intermediate stage 104. Intermediate stage 104 can be any type of structure which provides a road paving function beyond merely physically connecting a tool to a tractor. Intermediate stage 104 is shown as a spreading screw for hot mix asphalt distribution. Numerous types of HMA spreading screws could be employed as well.

Intermediate stage 104 is coupled to third stage screed road paving tool attachment 106 via second stage-to-stage coupler 105 and second stage-to-stage coupler 107. Second stage-to-stage coupler 105 and second stage-to-stage coupler 107 may be any type of coupler including a coupler which is configured for rapidly interchanging tool attachments in the field.

Figure 2:
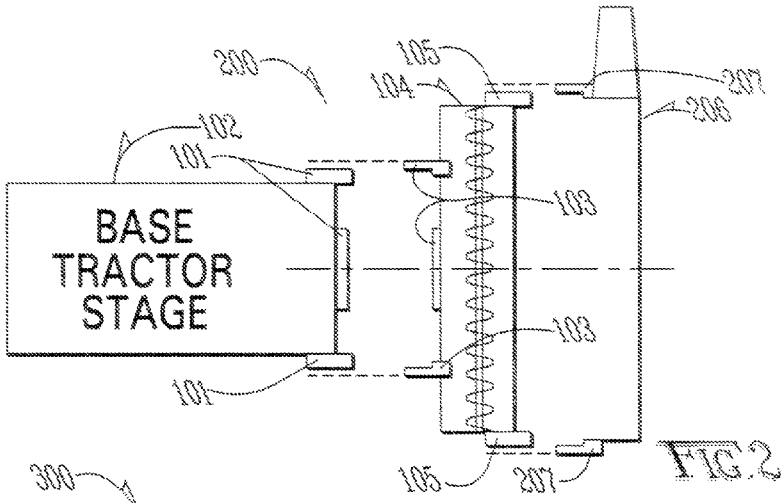
FIG. 2 is an exploded block diagram view of a multi-stage model of road paving equipment having a base stage, an intermediate stage of FIG. 1, and a second tool stage which is configured to mate with the intermediate stage.

Now referring to FIG. 2, there is shown a road widener apparatus generally designated 200, which includes a base tractor stage 102, intermediate stage 104 and a third stage road widener paving tool attachment 206 coupled to the intermediate stage 104 via second stage-to-stage coupler 105 and second stage-to-stage coupler 207. Second stage-to-stage coupler 207 could be any type of coupler including one that is configured for rapidly interchanging tool attachments in the field.

Figure 3:
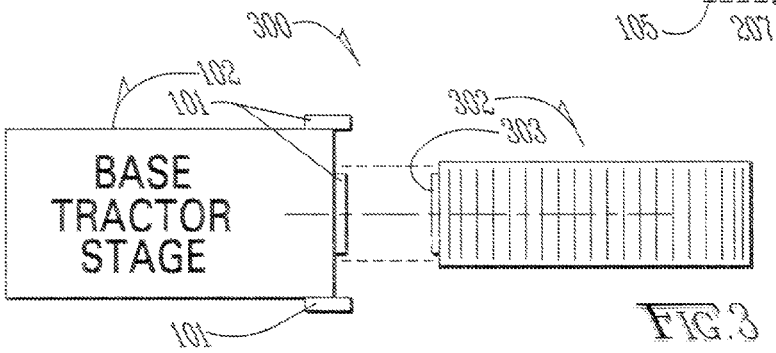
FIG. 3 is an exploded block diagram view of a dual-stage model of road paving equipment having the base stage of FIGS. 1 and 2, and third tool stage which is configured to mate with the base stage.

Now referring to FIG. 3, there is shown a road paving HMA elevator type system generally designated 300, which includes a base tractor stage 102 having a first stage-to-stage coupler 101 thereon. One of the key aspects of the present invention is that prior art tool attachments which have been proposed to fit on a single coupler on a tractor are limited because of the nature of the coupler. The second stage swinging slat conveyor tool attachment 302 is coupled directly to the base tractor stage 102 via first stage-to-stage coupler 101 and first stage-to-stage coupler 303. Second stage swinging slat conveyor tool attachment 302 would not be able to be coupled to second stage-to-stage coupler 105 as are the tool attachments third stage screed road paving tool attachment 106 and third stage road widener paving tool attachment 206.

The method of the present invention could be performed as follows:

Step 1. Manufacture a base tractor stage 102 with a first stage-to-stage coupler 101 thereon.

Step 2. Manufacture an intermediate stage 104 with a second stage-to-stage coupler 105 thereon.

Step 3. Manufacture a third stage screed road paving tool attachment 106, a third stage road widener paving tool attachment 206 and a second stage swinging slat conveyor tool attachment 302.

Step 4. Maintain these products in inventory in close proximity to a final assembly area.

Step 5. Receive an inquiry about a first particular model of road paving equipment.

Step 6. Assemble the first particular model of road paving equipment using the base tractor stage 102 and one of the attachments manufactured in Step 3.

The step of assembly will include a step of attaching a structure to the base tractor stage 102 in such a manner that it is not configured for rapid detachment and reattachment in the field.

Step 7. Replenish the inventory with products which were used to build the first particular paving equipment.

It is thought that the method and apparatus of the present invention will be understood from the foregoing description and that it will be apparent that various changes may be made in the form, construct steps, and arrangement of the parts and steps thereof, without departing from the spirit and scope of the invention or sacrificing all of their material advantages. The form herein described is merely a preferred exemplary embodiment thereof.

I claim:

1. A multi-stage road paving equipment system comprising:

a base tractor first stage for providing basic controls and motive forces and a first stage-to-stage coupling, disposed at a rear end of said base tractor;

an intermediate stage, configured to mate with the first stage-to-stage coupling and further configured with a second stage-to-stage coupling, said intermediate stage being disposed rearward of said rear end of said base tractor and centered with respect to a center line extending rearward from said rear end of said base tractor;

the intermediate stage is additionally configured to laterally transport hot mix asphalt away from said center line;

wherein the intermediate stage is rigidly coupled to the base tractor first stage via the first stage-to-stage coupler which is configured not to be readily decoupled and recoupled in the field; and a first of a plurality of third stage road paving tool attachments configured to mate with the second stage-to-stage coupling, where each of the plurality of third stage tool attachment provides a differing function and where each of the plurality of third stage road paving tool attachments is not configured to be directly mated to the first stage-to-stage coupling.

2. The system of claim 1 wherein the intermediate stage comprises a spreading screw for hot mix asphalt; and the first of a plurality of third stage road paving tool attachments comprises a screed attachment.

3. The system of claim 1 wherein the first of a plurality of third stage road paving tool attachments comprises a road widener.

4. The system of claim 1 wherein the intermediate stage is coupled to the base tractor first stage via the first stage-to-stage coupler which consists of one of welding, bolts and rivets.

5. The system of claim 4 wherein the second stage-to-stage coupler is configured to be readily decoupled and recoupled in the field, with a blind mateable connection.

6. The system of claim 5 wherein the first of a plurality of third stage road paving tool attachments comprises a screed attachment.

7. The system of claim 5 wherein the first of a plurality of third stage road paving tool attachments comprises a road widener attachment.

8. A multi-stage road paving equipment system comprising:

a base tractor configured for providing control and motive force;

a first stage-to-stage coupling mounted on the base tractor;

an intermediate stage, configured to mate with the first stage-to-stage coupling;

a second stage-to-stage coupling, mounted on said intermediate stage;

the intermediate stage is additionally configured to laterally transport hot mix asphalt;

a plurality of third stage road paving tool attachments configured to mate with the second stage-to-stage coupling, where each of the plurality of third stage tool attachment provides a differing function and where each of the plurality of third stage road paving tool attachments is not configured to be directly mated to the first stage-to-stage coupling;

wherein the intermediate stage is rigidly coupled to the base tractor via the first stage-to-stage coupler which is configured not to be readily decoupled and recoupled in the field, and which consists of one of welding, bolts, and rivets;

wherein the second stage-to-stage coupler is configured to be readily decoupled and recoupled in the field and is blind mateable; and wherein the intermediate stage comprises a spreading screw for distributing hot mix asphalt.

9. The system of claim 8 wherein a first of the plurality of third stage road paving tool attachments comprises a screed attachment.

10. The system of claim 9 wherein a second of the plurality of third stage road paving tool attachments comprises a road widener.

* * * * *